US008525624B2

(12) United States Patent
Rösch et al.

(10) Patent No.: US 8,525,624 B2
(45) Date of Patent: Sep. 3, 2013

(54) SHORT-CIRCUIT RELEASE HAVING AN OPTIMIZED MAGNETIC CIRCUIT

(75) Inventors: Bernhard Rösch, Sulzbach-Rosenberg (DE); Yi Zhu, Darmstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/540,702

(22) Filed: Jul. 3, 2012

(65) Prior Publication Data

US 2013/0009733 A1 Jan. 10, 2013

(30) Foreign Application Priority Data

Jul. 5, 2011 (EP) ..... 11172628

(51) Int. Cl.
*H01H 9/00* (2006.01)

(52) U.S. Cl.
USPC ..... 335/172

(58) Field of Classification Search
USPC ..... 335/172–176
See application file for complete search history.

(56) References Cited

U.S. PATENT DOCUMENTS

| | | | | |
|---|---|---|---|---|
| 2,840,663 | A | 6/1958 | Horn | |
| 4,443,775 | A | 4/1984 | Fujitani | |
| 4,816,798 | A | 3/1989 | Feller | |
| 5,808,534 | A * | 9/1998 | Laffey | 335/250 |
| 5,874,877 | A | 2/1999 | Kawashima et al. | |
| 5,910,758 | A * | 6/1999 | Maloney et al. | 335/35 |
| 8,258,905 | B2 * | 9/2012 | Ellwein et al. | 335/278 |

FOREIGN PATENT DOCUMENTS

| | | | |
|---|---|---|---|
| DE | 3619239 | A1 | 12/1987 |
| DE | 19732882 | A1 | 2/1998 |

OTHER PUBLICATIONS

European Search Report for European Application No. EP 11172628.7 dated Dec. 2, 2011.

* cited by examiner

*Primary Examiner* — Bernard Rojas
(74) *Attorney, Agent, or Firm* — Harness, Dickey & Pierce, P.L.C.

(57) ABSTRACT

A short-circuit release is disclosed, in particular for a power circuit-breaker. In at least one embodiment, the short circuit release includes an armature and pole that are located inside a coil former and further includes a yoke plate and terminal connection that are positioned around the coil former. Arranged opposite the yoke plate is a magnetic plate resting against the terminal connection.

18 Claims, 3 Drawing Sheets

SHORT-CIRCUIT RELEASE HAVING AN OPTIMIZED MAGNETIC CIRCUIT

PRIORITY STATEMENT

The present application hereby claims priority under 35 U.S.C. §119 to European patent application number EP 11172628.7 filed Jul. 5, 2011, the entire contents of which are hereby incorporated herein by reference.

FIELD

At least one embodiment of the invention generally relates to a short-circuit release, in particular for a power circuit-breaker, having an armature and pole that are located inside a coil former and further having a yoke plate and terminal connection that are positioned around the coil former.

BACKGROUND

Short-circuit releases are employed in power circuit-breakers for switching and protecting motors and other loads. The short-circuit releases are designed as electromagnetic tripping devices substantially comprising a coil winding, a coil former, an armature, a pole, a plunger, a restraining spring, and a yoke. The armature is attracted at a specific rated current of the power circuit-breaker, for example at twelve times the nominal current in the case of motor protection or nineteen times the nominal current in the case of transformer protection. The armature's motion therein acts upon a breaker mechanism and a moveable contact member in order to open the contacts. The relevant standard therein specifies that the operating current can vary by at most +/−20%.

Because of the requisite larger supporting cross-sections, smaller numbers of turns, wider tolerances for the coil and wrap wire, and the greater magnetic-field inhomogeneity associated therewith, the difficulty with relatively wide adjustment ranges lies in positioning the coil winding with respect to the air gap between the armature and pole sufficiently accurately to enable the operating limits to conform to the relevant standard. There is also the problem of fixing the coil winding in its determined position with respect to the air gap so that the coil winding will not become displaced in the direction of the center of gravity of the iron at the rated current or when the short-circuit current is high, or if the coil contracts and becomes deformed with the result that the operating limits will then no longer be adhered to.

For higher breaking capacities the coils are produced having the winding turns resting on them so that the coil cannot contract and become deformed in the event of high short-circuit currents. Owing to the use of uniform coil formers for the respective structural size and the fact that they are designed for the geometrically largest coil winding, there is often a gap between the coil-former flange or yoke and the last turn of the coil winding. In order to fix the coil winding once it has been positioned accurately with respect to the air gap between the armature and pole, one of the coil winding's ends is bonded to the coil-former flange or yoke and the other is welded to a terminal.

The short-circuit release has to be matched in the case of power circuit-breakers having a high breaking capacity, for example up to 100 kA for a nominal current of 80 A. The high breaking capacity of an 80-A device makes its heat management critical. Moreover, the force requirements on the release are also increased because of the growing contact load. The magnetic circuit needs to be more efficient in its structural design given that the release's power dissipation must not exceed that of today's 50-A release with a field strength correspondingly the same.

Present-day switching devices have a relatively poor magnetic circuit because the yoke plate is at the same time embodied as a bimetallic support and made from a platinized material, for example an iron/copper mating.

That problem of a relatively poor magnetic circuit has hitherto been resolved by way of a platinized copper/steel plate and a corresponding arrangement of the parts. Partially bonded materials can furthermore be produced and then shaped appropriately arranged for the required material mating. Likewise used are differently shaped yoke plates which encompass the release's core consisting of an armature and pole in order to interact with the coil and achieve a release effect. The force level of said releases is maintained by a field strength that is highly dimensioned. That means an inefficient energy conversion between electrical and mechanical energy.

SUMMARY

At least one embodiment of the present invention provides a short-circuit release, in particular for a power circuit-breaker, that has an improved magnetic circuit with a high breaking capacity.

Advantageous embodiments and developments that can be used in combination with each other are the subject matter of the dependent claims.

A short-circuit release of at least one embodiment, in particular for a power circuit-breaker, includes an armature and pole that are located inside a coil former and further having a yoke plate and terminal connection that are positioned around the coil former. In at least one embodiment of the invention, the yoke plate is arranged opposite a magnetic plate resting against the terminal connection.

BRIEF DESCRIPTION OF THE DRAWINGS

Further advantages and embodiments of the invention are explained below with the aid of example embodiments and the schematics.

Figure 2:
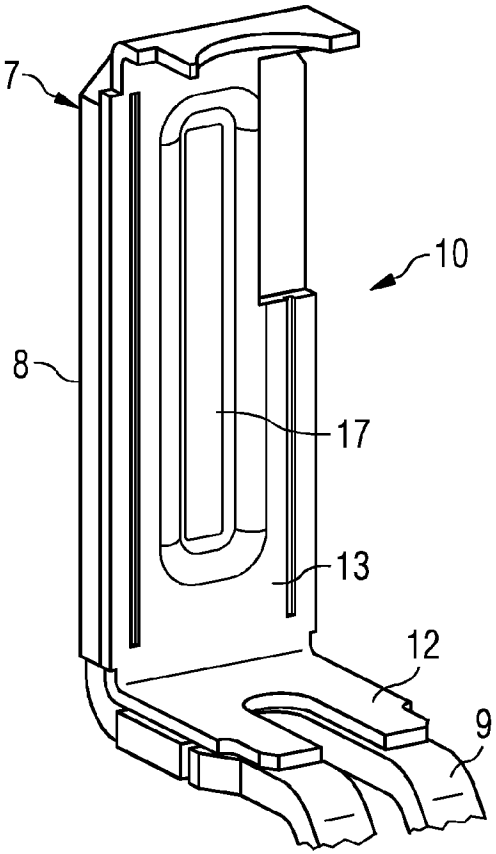
FIG. 2 is a perspective representation of a terminal connection with a magnetic plate arranged thereon.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In at least one embodiment, there exists a mutual arrangement of the yoke plate and magnetic plate produced from two single parts with no direct connection to the terminal connection. The terminal connection is likewise produced as a single part assuming the function of a conducting path. The additional magnetic plate reduces the magnetic loss substantially. That arrangement of the non-platinized magnetic plate is platinized only in the region where it is technically necessary for magnetic purposes. It is an arrangement that is in part not possible in the case of a platinized strip material such as, for instance, copper or iron. The terminal connection would therein be made throughout from a platinized shapeable material. Partially combining two primary materials by way, for example, of roller-track welding cannot be employed because the metal structure would be altered by the heat applied for welding such as to produce unacceptable effects on the magnetic circuit. The high cost of the primary material is also a decisive factor for separating the magnetic plate and terminal connection.

The form-fit mating of the magnetic plate and terminal connection is therein essential. A depression or, as the case may be, impression has preferably been provided in the magnetic plate. The depression or impression is arranged axially parallel to the middle of the axis of the short-circuit release to provide the space needed for the adjoining coil turns. The requisite cross-section can therein vary as much as is needed owing to the coil's design. That will also make it possible to optimize the installation space in the device as a whole and allow fabrication tolerances. A corresponding free space in the terminal connection is a prerequisite for implementing the impression in the magnetic plate.

Another major advantage of at least one embodiment is that an unnecessary loss in the current path can be avoided through the parts' being individually mated.

It is also possible to embody a recess on the magnetic plate. That separate recess can be produced on account of the parts' being individually mated. That will make an optimized welded joint possible as well as lower electrical resistance because two materials of the same kind can then be welded together, in the present case the coil and terminal connection. Welding directly on the magnetic plate or a platinized strip material will result in a significant deterioration in the magnetic circuits. Possible additional welding can moreover lead to increased manufacturing costs. Another advantage is that the terminal connection connects the path from the coil to the terminal clamp, with its being possible for the temperature on the terminal clamp to be reduced owing to the long route from the current path.

Also preferably provided on the terminal connection is a recess by which the overhangs due to welding beads can be compensated so that the risk of installation errors can be avoided. It is also possible to employ the economical WIG welding process.

Another advantageous embodiment variant provides for the welding region to be embodied as being bent round at the terminal connection so as to produce an area for connecting the parts. The size is optimized in keeping with the necessary current transfer and least electrical resistance. A welded joint can herein be implemented as can also a soldered joint.

It is also advantageously provided for the individual parts made from the magnetic plate and terminal connection to be able to be treated as bulk materials. They can—but do not have to be—joined together in a form-fit manner. The external shape along with tolerance coordinating will enable the parts to be placed one inside the other and inserted snugly into the coil former so that the magnetic plate will be pressed directly against the pole area from below. Permanently joining the two parts is costly, but that course will be circumvented by installing parts in the coil former's molding post or, as the case may be, pressing them into it in a manner that provides an exact fit.

The short-circuit release of at least one embodiment, in particular for a power circuit-breaker, has an armature and pole that are located inside a coil former. A coil has been wound onto the coil former. The coil former is framed by a yoke plate and a terminal connection. The yoke plate is embodied preferably as U-shaped. The terminal connection surrounds the coil former including the coil preferably with two mutually orthogonal limbs. Arranged on the terminal connection's two limbs is a magnetic plate that is embodied preferably as U-shaped and has two limbs as well as a transitional region. The magnetic plate's transitional region therein rests against a first limb of the terminal connection. One of the magnetic plate's limbs rests against a second limb of the terminal connection. The magnetic plate's other limb is anchored in the coil former. The coil has two ends. One of the coil's ends is connected to the overload protection. The coil's other end is welded to the terminal connection. Located under one of the terminal connection's limbs is a plunger which is guided inside a contact-slide device of the power circuit-breaker.

The short-circuit release of at least one embodiment having an optimized magnetic circuit exhibits a good magnetic design accompanied by a reduced electrical loss. A lower magnetic field strength is required, which is associated with reduced power dissipation. The fact that no platinized primary material is used also minimizes the space requirements. The way the parts are mutually arranged has been optimized. It is also advantageous that the individual parts can be treated as bulk materials. The present short-circuit release of at least one embodiment will moreover allow the dimensions and tolerances to be defined more precisely. The extended current path from the N release to the terminal clamps also produces a drop in the clamp temperature. An economical solution for high breaking capacities in a power circuit-breaker has been provided by the present short-circuit release of at least one embodiment.

Figure 1:
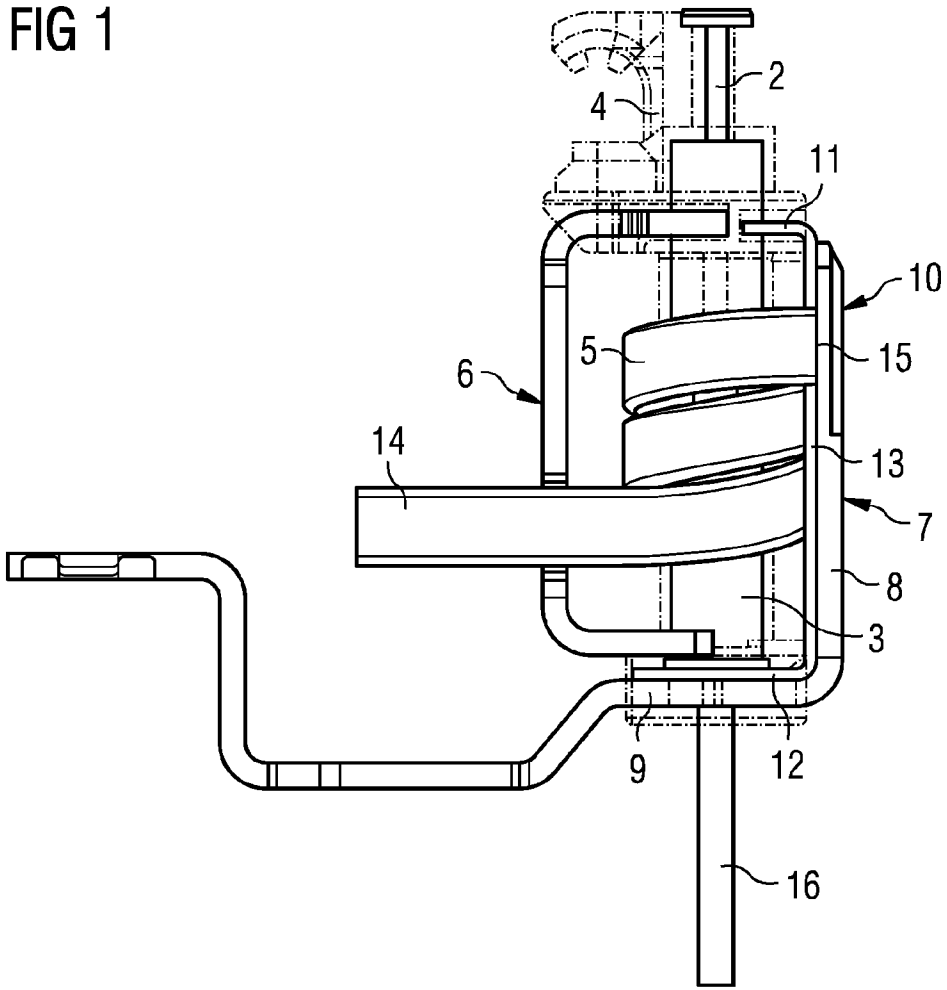
FIG. 1 is a perspective representation of an embodiment of a short-circuit release having an additional magnetic plate.

FIG. 1 shows an inventive short-circuit release 1, in particular for a power circuit-breaker, having an armature 2 and pole 3 that are located inside a coil former 4. A coil 5 has been wound onto coil former 4. Coil former 4 is framed by a yoke plate 6 and a terminal connection 7. Yoke plate 6 is embodied preferably as U-shaped. Terminal connection 7 surrounds coil former 4 including coil 5 preferably with two mutually orthogonal limbs 8, 9. Arranged on the two limbs 8, 9 of terminal connection 7 is a magnetic plate 10 that is embodied preferably as U-shaped and has two limbs 11, 12 as well as a transitional region 13. Transitional region 13 of magnetic plate 10 therein rests against limb 8 of terminal connection 7. Limb 12 of magnetic plate 10 rests against limb 9 of terminal connection 7. Limb 11 of magnetic plate 10 is anchored in coil former 4. Coil 5 has two ends 14, 15. End 14 of the coil is connected to the overload protection (not shown). End 15 of coil 5 is welded onto terminal connection 7. Located under limb 9 of terminal connection 7 is a plunger 16 which is guided inside a contact-slide device of the power circuit-breaker (not shown).

FIG. 2 shows terminal connection 7 with magnetic plate 10 arranged thereon. Magnetic plate 10 is therein arranged on limbs 8, 9 of terminal connection 7. Transitional region 13 of magnetic plate 10 therein rests against limb 8 of terminal connection 7. Limb 12 of magnetic plate 10 rests against limb 9 of terminal connection 7. Arranged in magnetic plate 10 axially parallel to the middle of the axis of the short-circuit release is a depression 17 or, as the case may be, impression to provide the space needed for the adjoining coil. The requisite cross-section can therein vary as much as is needed owing to the coil's design. That will also make it possible to optimize the installation space in the device as a whole and make fabrication tolerances available. A corresponding free space in the terminal connection is a prerequisite for implementing the impression in magnetic plate 10.

Figure 3:
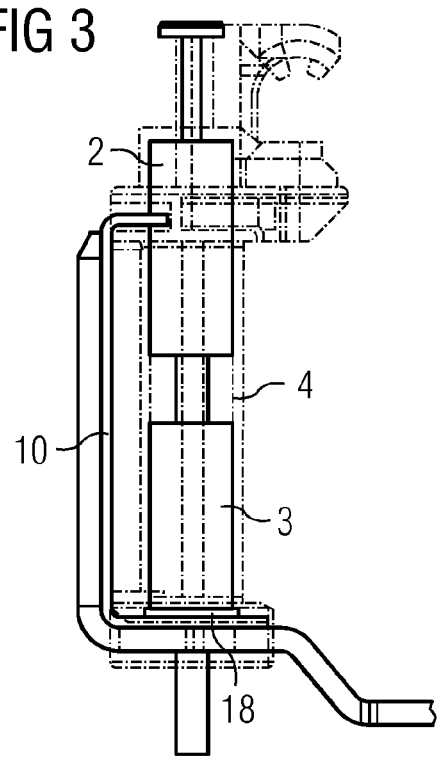
FIG. 3 is a sectional representation of the coil former having an armature and yoke, also showing the arrangement between the pole area and magnetic plate.

FIG. 3 shows coil former 4 having armature 2 and pole 3 and the arrangement between pole area 18 and magnetic plate 10. The individual parts of the magnetic plate and terminal connection can be treated as bulk materials. They can, but do not have to be, joined together in a form-fit manner. The external shape along with tolerance coordinating will enable the parts to be placed one inside the other and inserted snugly into the coil former so that the magnetic plate will be pressed directly against pole area 18 from below. Permanently joining the two parts is costly, but that course will be circumvented by installing parts in the molding post of coil former 4 or, as the case may be, pressing them into it in a manner that provides an exact fit.

Figure 4:
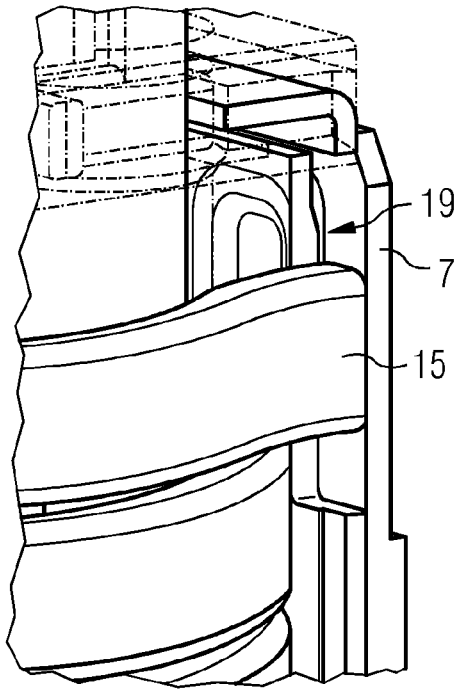
FIG. 4 is a perspective representation of the connection between a coil end and the terminal connection.

FIG. 4 shows the connection between coil end 15 and terminal connection 7. A recess 19 is for that purpose embodied on magnetic plate 10 so that coil end 15 can be welded onto terminal connection 7.

Figure 5:
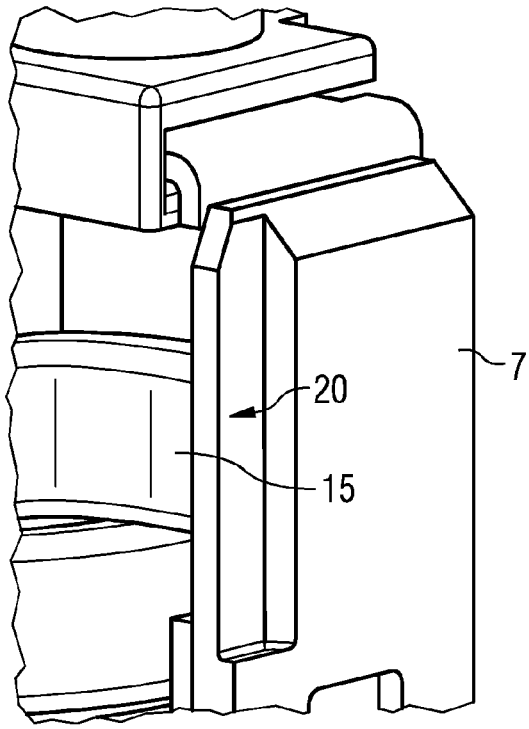
FIG. 5 is a perspective representation of the coil terminal as shown in FIG. 4 having a recess on the terminal connection.

FIG. 5 shows the coil terminal as shown in FIG. 4 on terminal connection 7, with an additional recess 20 being shown on terminal connection 7. Overhangs due to welding beads will be compensated by means of recess 20 or, as the case may be, the depression in terminal connection 7 so that the risk of installation errors will be reduced and the more economical WIG welding process can be employed.

Figure 6:
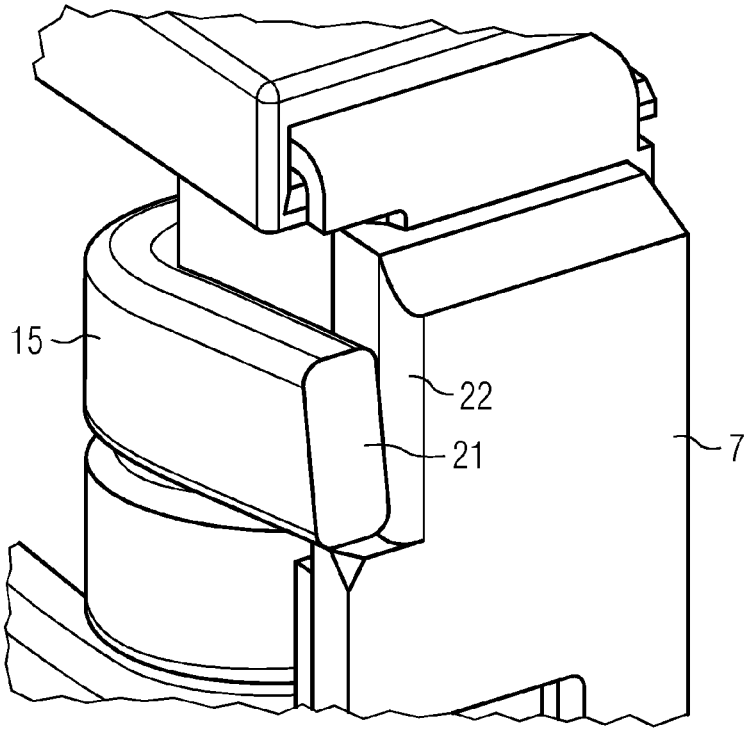
FIG. 6 is a perspective representation of another example embodiment of a coil terminal having a welding region that is bent round at the terminal connection.

FIG. 6 shows another example embodiment of a coil terminal having a welding region 21 that is bent round at terminal connection 7. Welding region 21 is therein bent round at terminal connection 7 so as to produce an area 22 for connecting the parts. The size is optimized in keeping with the necessary current transfer and least electrical resistance. A welded joint can herein be implemented; a soldered joint is equally possible.

The short-circuit release of at least one embodiment having an optimized magnetic circuit exhibits a good magnetic design accompanied by a reduced electrical loss. A lower magnetic field strength is required, which is associated with reduced power dissipation. The fact that no platinized primary material is used also minimizes the space requirements. The way the parts are mutually arranged has been optimized. It is also advantageous that the individual parts can be treated as bulk materials. The present short-circuit release of at least one embodiment will moreover allow the dimensions and tolerances to be defined more precisely. The extended current path from the N release to the terminal clamps also produces a drop in the clamp temperature. An economical solution for high breaking capacities in a power circuit-breaker has been provided by the present short-circuit release of at least one embodiment.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A short-circuit release, comprising:
- an armature and pole, located inside a coil former;
- a yoke plate and terminal connection, positioned around the coil former; and
- a magnetic plate, arranged opposite the yoke plate and resting against the terminal connection, wherein,
  - a wall of the magnetic plate includes a first recess exposing a surface of the terminal connection, and
  - the first recess is in a portion of the wall that is substantially parallel to a longitudinal axis of the short-circuit release.

2. The short-circuit release of claim 1, wherein the magnetic plate and terminal connection are mutually arranged in a form-fit manner.

3. The short-circuit release of claim 1, wherein a depression is provided in the magnetic plate.

4. The short-circuit release of claim 3, wherein the depression in the magnetic plate is arranged axially parallel to a middle of an axis of the short-circuit release.

5. The short-circuit release of claim 3, wherein a second recess is embodied in terminal connection corresponding to the depression in the magnetic plate.

6. The short-circuit release of claim 1, wherein the first recess is embodied on the magnetic plate in such a way as to enable a coil, wound onto the coil former, to be welded directly onto the terminal connection.

7. The short-circuit release of claim 6, wherein the terminal connection includes a second recess in the region of the coil-terminal weld.

8. The short-circuit release of claim 6, wherein a welding region, bent around, is embodied on the terminal connection so as to provide an area for a weld joint between the coil and terminal connection.

9. The short-circuit release of claim 1, wherein the short-circuit release is for a power circuit-breaker.

10. The short-circuit release of claim 2, wherein a depression is provided in the magnetic plate.

11. The short-circuit release of claim 10, wherein the depression in the magnetic plate is arranged axially parallel to a middle of an axis of the short-circuit release.

12. The short-circuit release of claim 4, wherein a second recess is embodied in terminal connection corresponding to the depression in the magnetic plate.

13. The short-circuit release of claim 10, wherein a second recess is embodied in terminal connection corresponding to the depression in the magnetic plate.

14. The short-circuit release of claim 11, wherein a second recess is embodied in terminal connection corresponding to the depression in the magnetic plate.

15. The short-circuit release of claim 2, wherein the first recess is embodied on the magnetic plate in such a way as to enable a coil, wound onto the coil former, to be welded directly onto the terminal connection.

16. The short-circuit release of claim 15, wherein the terminal connection includes a second recess in the region of the coil-terminal weld.

17. The short-circuit release of claim 15, wherein a welding region, bent around, is embodied on the terminal connection so as to provide an area for a weld joint between the coil and terminal connection.

18. A short-circuit release, comprising:

an armature and pole, located inside a coil former;

a yoke plate and terminal connection, positioned around the coil former; and a magnetic plate, arranged opposite the yoke plate and resting against the terminal connection, wherein a depression is provided in the magnetic plate and the depression in the magnetic plate is arranged axially parallel to a middle of an axis of the short-circuit release.

* * * * *